US011751304B1

(12) United States Patent
Lee

(10) Patent No.: US 11,751,304 B1
(45) Date of Patent: Sep. 5, 2023

(54) LED FEEDBACK VOLTAGE REGULATING DRIVING DEVICE

(71) Applicant: Wen-Sung Lee, Taichung (TW)

(72) Inventor: Wen-Sung Lee, Taichung (TW)

( * ) Notice: Subject to any disclaimer, the term of this patent is extended or adjusted under 35 U.S.C. 154(b) by 0 days.

(21) Appl. No.: 17/889,406

(22) Filed: Aug. 17, 2022

(51) Int. Cl.
*H05B 45/30* (2020.01)
*H05B 45/32* (2020.01)

(52) U.S. Cl.
CPC ..... *H05B 45/32* (2020.01)

(58) Field of Classification Search
CPC ..... H05B 45/00; H05B 45/24; H05B 45/30; H05B 45/32; H05B 45/34; H05B 45/345; H05B 45/37
See application file for complete search history.

(56) References Cited

U.S. PATENT DOCUMENTS

2007/0090774 A1* 4/2007 Ger ..... H05B 41/2853 315/291
2008/0297069 A1* 12/2008 Shao ..... H05B 45/38 315/307
2010/0084994 A1* 4/2010 Kao ..... H05B 45/395 315/307

* cited by examiner

*Primary Examiner* — Thai Pham

(57) ABSTRACT

A LED feedback voltage regulating driving device is provided. The LED feedback voltage regulating driving device includes a microcontroller, a first feedback circuit, a second feedback circuit, an oscillating circuit and a comparison circuit. The first feedback circuit and the second feedback circuit adjust the voltage and current from the electricity supply module and the driving circuit respectively, and transmit the voltage and current to the microcontroller; wherein, the microcontroller and the oscillating circuit reciprocate the voltage and current from the first feedback circuit and the second feedback circuit; wherein the comparison circuit compares the signal from the microcontroller and the oscillating circuit; wherein the pulse circuit adjusts the voltage and the current then transmits the voltage and current to the driving circuit for electricity driving; wherein, during the electricity driving, the driving circuit transmits part of the voltage and current to the second feedback circuit.

9 Claims, 2 Drawing Sheets

LED FEEDBACK VOLTAGE REGULATING DRIVING DEVICE

FIELD OF THE DISCLOSURE

The present disclosure is related to a device, in particular the technology used in the lighting field.

BACKGROUND OF THE DISCLOSURE

LED is one of the common light sources today, which provides exceptionally bright lighting. However, the disadvantage of LED is the poor heat dissipation and the short service life, which results in the light irradiation of LED gradually declining. Finally, it can no longer be used. Specifically, for many light-emitting devices on the market (such as car lights), when a single supply of voltage and current is used for the LED, the brightness of the car light will have the best lighting lumens in the early stage. However, the LED has poor heat dissipation and is in a closed space and has poor heat dissipation, so the efficiency of the LED will be significantly reduced under high-temperature conditions for a long time. Eventually, the LED may burn out and required to be replaced, wasting time and cost.

In addition, when the efficiency of the LED decreases, the voltage and current supply maintain a specific voltage and current without changing according to the LED performance, which will also accelerate the damage to the LED. Therefore, improving the electricity supply that maintains the life of the LED without affecting the light intensity is an important issue.

SUMMARY OF THE DISCLOSURE

The main objective of the present disclosure is to provide a LED feedback voltage regulating driving device that can supply the most suitable voltage and current to the LED, so that the LED can emit the strongest light under the most suitable voltage and current, thereby maintaining the service life of the LED. In the conventional technology, the driving of the LED is generally in a single voltage and current supply. However, the lighting efficiency of the LED gradually decreases due to the poor heat dissipation of the LED. In addition, the supply of voltage and current cannot be adjusted according to the decline in the efficiency of the LED, resulting in the shortening of the service life of the LED and other defects. In order to achieve the object and the advantage mentioned above, the present disclosure provides a LED feedback voltage regulating driving device, including: a microcontroller, including a control unit, a input unit and a output unit; a first feedback circuit, electrically connected to the input unit of the microcontroller and receiving electricity supply from an electricity supply module; a second feedback circuit, electrically connected to the input unit of the microcontroller and receiving electricity supply from a driving circuit; an oscillating circuit, forming a reciprocating loop with the input unit and output unit of the microcontroller; wherein the oscillator circuit receives the signal output by the output unit of the microcontroller, and returns it to the input unit of the microcontroller after calculation; and a comparison circuit, receiving the signal output by the microcontroller and the oscillating circuit, and outputs signal to the pulse circuit for voltage and current adjusting such as amplification, transformation and shaping, and then the adjusted pulse circuit and then transmits it to the driving circuit for electricity driving.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
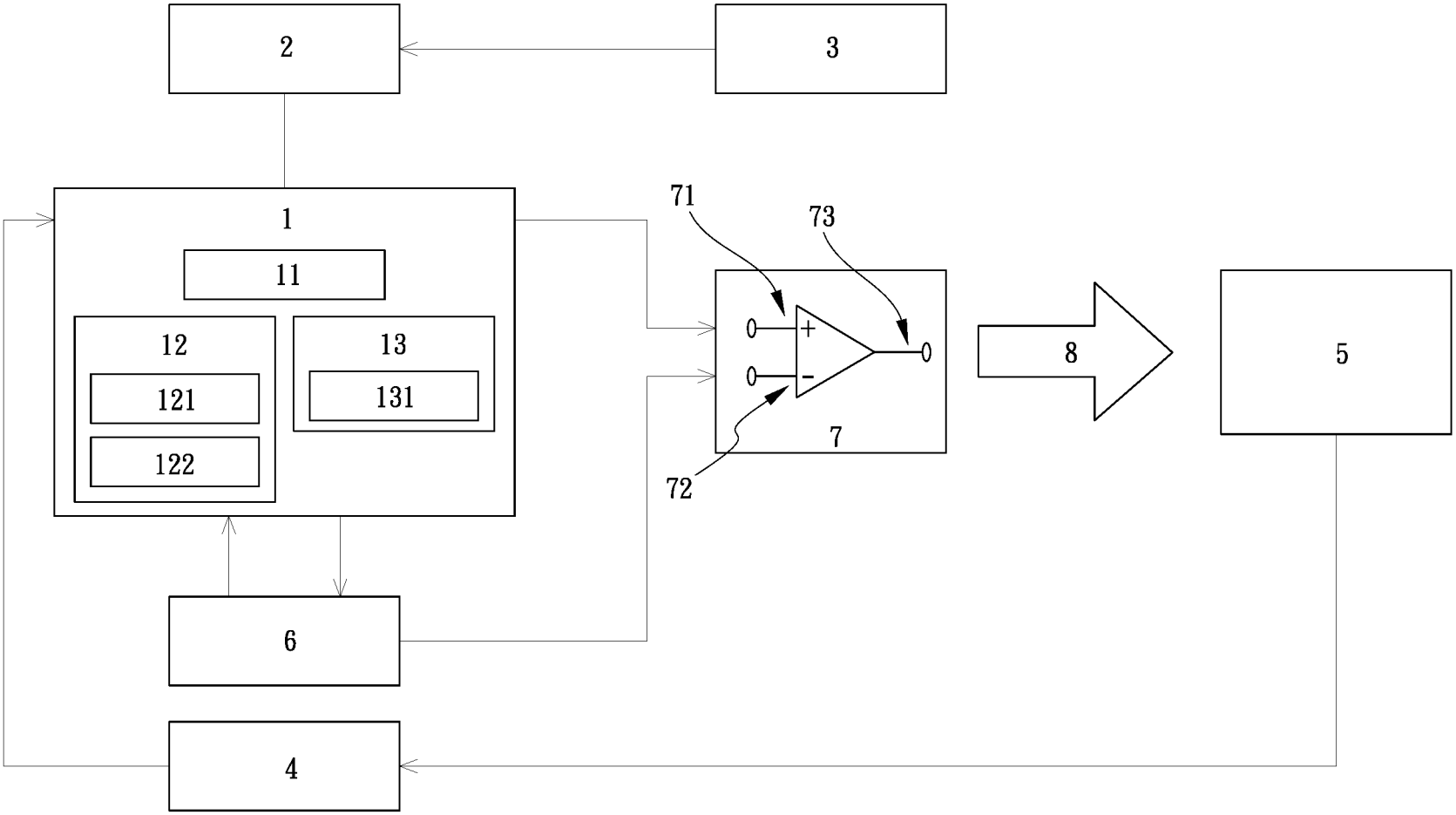
FIG. 1 is a block schematic diagram of the present disclosure.
Figure 2:
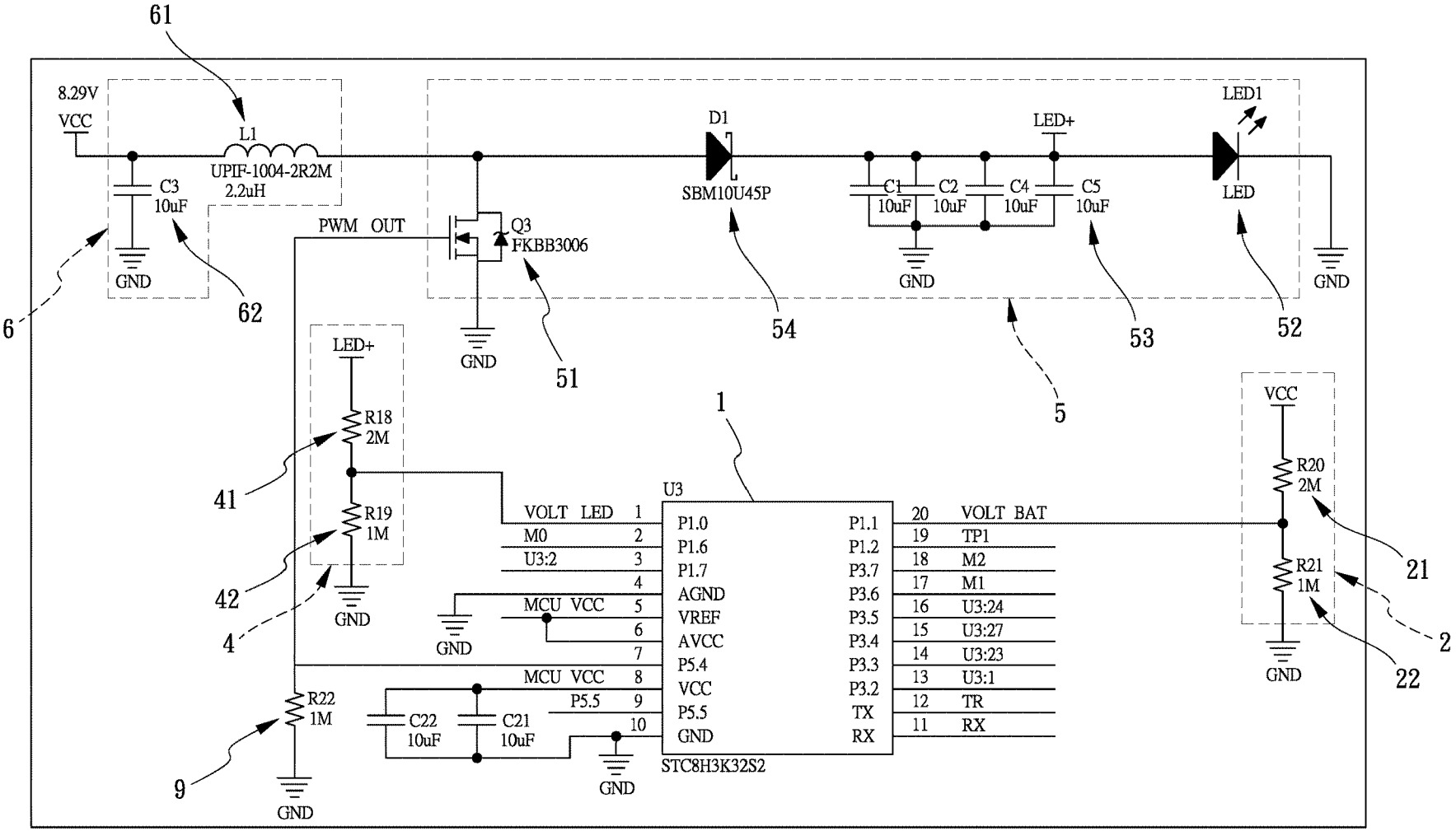
FIG. 2 is a schematic circuit diagram of the present disclosure.

Referring to FIG. 1 and FIG. 2, the present disclosure provides a LED feedback voltage regulating driving device, including: a microcontroller 1, a first feedback circuit 2, a second feedback circuit 4, an oscillating circuit 6 and a comparison circuit 7. The microcontroller 1 includes a control unit 11, an input unit 12 and an output unit 13. As the main core of the driving device of the present disclosure, the microcontroller 1 controls and converts the input and output of the signal by the control unit 11. The first feedback circuit 2 is electrically connected to the input unit 12 of the microcontroller 1 and receives electricity supply from an electricity supply module 3. The first feedback circuit 2 controls the input/output impedance and the bandwidth of the amplification circuit of the electricity supply module 3. The second feedback circuit 4 is electrically connected to the input unit 12 of the microcontroller 1 and receives electricity from a driving circuit 5, the second feedback circuit 4 is mainly used to reduce gain, noise sensitivity, nonlinear distortion and control the output/input impedance of the circuit. The oscillating circuit 6 forms a reciprocating loop with the input unit 12 and output unit 13 of the microcontroller 1, in which the oscillator circuit 6 receives the signal output by the output unit 13 of the microcontroller 1, and returns it to the input unit 12 of the microcontroller 1 after calculation. The comparison circuit 7 receives the signal output by the microcontroller 1 and the oscillating circuit 6, and outputs a signal to a pulse circuit 8 for amplification, transformation and shaping of voltage and current, and then transmits it to the driving circuit 5 for power driving.

Before the initial start, the voltage and current of the electricity from the electricity supply module 3 firstly are adjusted by the first feedback circuit 2, and then transmits the electricity to the microcontroller 1 for control, setting, and conversion by the control unit 11. At this time, the microcontroller 1 divides the voltage and current into two paths, and the voltage and current of one path will be transmitted to the oscillating circuit 6. The oscillating circuit 6 is mainly a circuit that converts the DC electricity of the electricity supply module 3 into an AC signal with a specific frequency, generates AC oscillation as a signal source, and then transmits it back to the microcontroller 1 to form a reciprocating loop. The voltage and current of the other path of the microcontroller 1 will be directly transmitted to the comparison circuit 7. Through the comparison circuit 7, the output of the microcontroller 1 and the output of the oscillating circuit 6 are compared at the same time. After the comparison is completed, it will be transmitted to the pulse circuit 8 for final trimming of wavelength, frequency, etc., and finally transmitted to the driving circuit 5 for driving use.

In order to allow the driving circuit 5 to obtain the most suitable electricity, the driving circuit 5 transmits part of the electricity to the second feedback circuit 4 for adjustment. After the adjustment, the electricity is transmitted to the input unit 12 of the microcontroller 1, and proceed the control, convert and other processes in the microcontroller 1. That is to say, under the uninterrupted reciprocating adjustment of the electricity from the electricity supply module 3, the driving circuit 5 obtains the most suitable electricity. The service life of the driving circuit 5 can be maintained, the number of replacements can be reduced, and reduce the cost.

The driving circuit 5 of the present disclosure includes field-effect transistor 51, LED 52 and a plurality of capacitors 53. The plurality of capacitors 53 are connected in parallel with each other and form two nodes (top and bottom), one node is electrically connected to the LED 52, the other is electrically connected to the voltage stabilizing diode 54. The voltage stabilizing diode 54 can stabilize the voltage and current, so as to provide each capacitor 53 with a stable voltage, so that the plurality of capacitors 53 can reliably perform voltage filtering and energy storage of the pulse voltage source. Further, the voltage stabilizing diode 54 is electrically connected to the DRAIN of the field-effect transistor 51 and the oscillating circuit 6. Moreover, the output unit 13 of the microcontroller 1 further includes a first output point 131 electrically connected to the driving circuit 5, and electrically connected to a GATE of the field-effect transistor 51. A first resistance element 9 is further electrically connected to the junction of the first output point 131 and the field-effect transistor 51, the first resistance element 9 reduces the impedance output by the microcontroller 1, and the resistance value of the first resistance element 9 is 1 MΩ. The source of the field-effect transistor is grounded. Thus, when the field-effect transistor 51 is turned on, the voltage of the oscillating circuit 6 is charged with voltage, and when the field-effect transistor 51 is turned off, the oscillating circuit 6 is discharged with inductance. The conversion process between the charging and discharging inverts the voltage that passes through and generates a counter-electromotive force (counter emf), gradually boosting the voltage higher than the input voltage. The switching duty ratio and frequency of the bias signal input to the GATE of the field effect transistor 51 can determine the ratio of the voltage boost.

Further, the oscillating circuit 6 includes a driving coil 61 and an oscillating capacitor 62. When the field-effect transistor 51 is turned on, the driving coil 61 is charged, and the discharge is also performed in the driving coil 61. The input unit 12 of the microcontroller 1 further includes a first input point 121 receiving voltage of the first feedback circuit 121, and a second input point 122 receiving the electricity from the electricity supply module 3. The voltage of the first feedback circuit 2 enters the control unit 11 of the microcontroller 1 through the first input point 121, and the electricity of the electricity supply module 3 enters the control unit 11 of the microcontroller 1 through the second input point 122 for calculation, and are simultaneously transmitted from the output unit 13 to the oscillating circuit 6 and the comparison circuit 7. The signal transmitted to the oscillating circuit 6 will be repeatedly adjusted and then transmitted back to the microcontroller 1, and the signal transmitted to the comparison circuit 7 will be compared with the signal transmitted by the oscillating circuit 6. Through the field-effect transistor 51, the signal output of the first output point 131 of the microcontroller 1 stays stable.

In order to maintain better transmission of electricity, appropriate impedance can be applied to reduce the voltage and current, so as to prevent the voltage and current from being too large to affect the entire device. The first feedback circuit 2 further includes a second resistance element 21 and a third resistance element 22. The second resistance element 21 and the third resistance element 22 are serially connected and a node is formed and electrically connected to the input unit 12 of the microcontroller. Regarding the resistance value, the resistance value of the second resistance element 21 is 2 MΩ, and the resistance value of the third resistance element 22 is 1 MΩ. Similarly, the second feedback circuit 4 further includes a fourth resistance element 41 and a fifth resistance element 42, the fourth resistance element 41 and the fifth resistance element 42 are serially connected and a node is formed and electrically connected to the input unit 12 of the microcontroller 1. Further, the resistance value of the fourth resistance element 41 is 2 MΩ, and the resistance value of the fifth resistance element 42 is 1 MΩ. By virtue of the above-mentioned setting, the device of the present disclosure can prevent burning the LED 52 during transmitting voltage and current.

Regarding the comparison circuit 7, firstly the comparison circuit 7 is also known as an operational comparator. The comparison circuit 7 includes a non-inverting input 71, an inverting input 72 and an output terminal 73. In which, when the voltage at the non-inverting input 71 is higher than the voltage at the inverting input 72 (the voltage output from the microcontroller 1 higher than the voltage output from the oscillating circuit 6), a non-inverting saturation voltage is outputted at the output terminal 73; when the voltage at the inverting input 72 is higher than the voltage at the non-inverting input 71, an inverting saturation voltage is outputted at the output terminal 73. Furthermore, the transfer function formula is $V_{out}=A_0(V_1-V_2)$, wherein the $V_{out}$ is the voltage output by the output terminal 73, $V_1$ is the voltage at the non-inverting input 71, $V_2$ is the voltage at the inverting input terminal 72, and $A_0$ is the open-loop amplification gain, as shown in FIG. 2. In other words, after repeated adjustment of the microcontroller 1 and the oscillating circuit 6, and the comparison in the comparison circuit 7, the device of the present disclosure provides the best voltage and current for the LED 52 of the driving circuit 5, so that the service life of the LED 52 can be maintained. The cost increase caused by the rapid wear and tear can be avoided.

Lastly, the capacitors 53 and the oscillating capacitor 62 in the oscillating circuit 6 are used with a value of 10 μF; The voltage stabilizing diode 54 electrically connected between the plurality of capacitors 53 and the DRAIN of the field-effect transistor 51 is also known as "Zener diode." The device of the present disclosure utilizes the collapse effect formed by the voltage stabilizing diode 54 under the action of the reverse voltage, thereby stabilizing voltage flowing through LED 52 to avoid burning of LED 52.

What is claimed is:

1. A LED feedback voltage regulating driving device, comprising:

a microcontroller, including a control unit, an input unit and an output unit;

a first feedback circuit, electrically connected to the input unit of the microcontroller and receiving electricity supply from an electricity supply module;

a second feedback circuit, electrically connected to the input unit of the microcontroller and receiving electricity input from a driving circuit;

an oscillating circuit, forming a reciprocating loop with the input unit and output unit of the microcontroller; wherein the oscillator circuit receives a signal output b the output unit of the microcontroller, and returns the signal to the input unit of the microcontroller after calculation of the voltage and current; and a comparison circuit, receiving the signal output by the microcontroller and the oscillating circuit, and outputting the signal to a pulse circuit for adjusting voltage and current such as amplification, conversion, transformation and shaping, and then transmitting the voltage and current to the driving circuit for electricity driving;

wherein, the first feedback circuit and the second feedback circuit adjust the voltage and current from the electricity supply module and the driving circuit respectively, and transmit the voltage and current to the microcontroller;

wherein, the microcontroller and the oscillating circuit reciprocate the voltage and current from the first feedback circuit and the second feedback circuit; wherein the comparison circuit compares the signal from the microcontroller and the oscillating circuit;

wherein the pulse circuit adjusts the voltage and the current for stable, then transmits the voltage and current to the driving circuit for electricity driving;

wherein, during the electricity driving, the driving circuit transmits part of the voltage and current to the second feedback circuit.

2. The LED feedback voltage regulating driving device according to claim 1, wherein the driving circuit includes a field-effect transistor, a LED and a plurality of capacitors, the plurality of capacitors are parallelly connected, and one of the terminals is electrically connected to one terminal of the LED, the other terminal is electrically connected to a DRAIN of the field-effect transistor, and the other terminal of LED is grounded; wherein, the field-effect transistor is connected with the parallelly connected capacitors and further tapped to the oscillating circuit; wherein, when the field-effect transistor is turned on, the voltage of the oscillating circuit is charged with voltage, and when the field-effect transistor is turned off, the oscillating circuit is discharged with inductance; wherein, a conversion process between the charging and discharging of the oscillating circuit generates a counter-electromotive force.

3. The LED feedback voltage regulating driving device according to claim 2, wherein the input unit of the microcontroller further it a first input point receiving voltage of the first feedback circuit, and a second input point receiving the electricity from the electricity supply module; wherein, the voltage of the first feedback circuit enters the control unit of the microcontroller through the first input point and the electricity of the electricity supply module enters the control unit of the microcontroller through the second input point, after operation signals are transmitted from the output unit to the oscillating circuit and the comparison circuit, the signal transmitted to the oscillating circuit will be repeatedly adjusted and then transmitted back to the microcontroller, and the signal transmitted to the comparison circuit will be compared with the signal transmitted from the oscillating circuit.

4. The LED feedback voltage regulating driving device according to claim 3, wherein the output unit of the microcontroller further includes a first output point electrically connected to the driving circuit, and electrically connected to a GATE of the field-effect transistor; wherein a first resistance element is further electrically connected at the junction of the first output point and the field-effect transistor, the first resistance element reduces the impedance output by the microcontroller, and a resistance value of the first resistance element is 1 MΩ.

5. The LED feedback voltage regulating driving device according to claim 4, wherein the oscillating circuit further includes a driving coil and an oscillating capacitor; wherein, when the field-effect transistor is turned on, the driving coil in the oscillating circuit is charged with voltage, when the field-effect transistor is turned off, the driving coil is discharged with inductance; wherein, during the conversion process between the charging and discharging of the inductance, the voltage is inverted to generate a counter-electromotive force, and then the voltage is gradually increased.

6. The LED feedback voltage regulating driving device according to claim 2, further comprising a voltage stabilizing diode electrically connected between the plurality of capacitors and the DRAIN of the field-effect transistor.

7. The LED feedback voltage regulating driving device according to claim 1, wherein the first feedback circuit further includes a second resistance element and a third resistance element; wherein the second resistance element and the third resistance element are serially connected and a node is formed and electrically connected to the input unit of the microcontroller; wherein a resistance value of the second resistance element is 2 MΩ, and the resistance value of the third resistance element is 1 MΩ.

8. The LED feedback voltage regulating driving device according to claim 1, wherein the second feedback circuit further includes a fourth resistance element and fifth resistance element; wherein the fourth resistance element and the fifth resistance element are serially connected and a node is formed and electrically connected to the input unit of the microcontroller; wherein a resistance value of the fourth resistance element is 2 MΩ, and the resistance value of the fifth resistance element is 1 MΩ.

9. The LED feedback voltage regulating driving device according to claim 1, wherein the comparison circuit is an operational comparator, and the comparison circuit further includes a non-inverting input, an inverting input and an output terminal; when the voltage at the non-inverting input is higher than the voltage at the inverting input, a non-inverting saturation voltage is output at the output terminal; when the voltage at the inverting input is higher than the voltage at the non-inverting input, an inverting saturation voltage is output at the output terminal; wherein a transfer function formula is $V_{out}=A_0(V_1-V_2)$, wherein the $V_{out}$ is the voltage output by the output terminal, $V_1$ is the voltage at the non-inverting input terminal, $V_2$ is the voltage at the inverting input terminal, and $A_0$ is an open-loop amplification gain.

* * * * *